US010760858B2

(12) United States Patent
Schmidt et al.

(10) Patent No.: US 10,760,858 B2
(45) Date of Patent: Sep. 1, 2020

(54) COATED HEAT EXCHANGER

(71) Applicant: Carrier Corporation, Farmington, CT (US)

(72) Inventors: Wayde R. Schmidt, Pomfret Center, CT (US); Scott Alan Eastman, Glastonbury, CT (US); Alexander Norman, Houston, TX (US); Sonia Tulyani, Glastonbury, CT (US); Jodi A. Vecchiarelli, Feeding Hills, MA (US); Caitlyn McIntyre Thorpe, Bolton, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/500,888

(22) PCT Filed: Jul. 31, 2015

(86) PCT No.: PCT/US2015/043225
§ 371 (c)(1),
(2) Date: Jan. 31, 2017

(87) PCT Pub. No.: WO2016/019303
PCT Pub. Date: Feb. 4, 2016

(65) Prior Publication Data

US 2017/0234629 A1 Aug. 17, 2017

Related U.S. Application Data

(60) Provisional application No. 62/031,740, filed on Jul. 31, 2014.

(51) Int. Cl.
*F28F 13/18* (2006.01)
*F28F 19/02* (2006.01)
(Continued)

(52) U.S. Cl.
CPC ..... *F28F 19/04* (2013.01); *F25B 13/00* (2013.01); *F25B 39/00* (2013.01); *F25B 39/02* (2013.01); *F25B 39/04* (2013.01)

(58) Field of Classification Search
CPC . F28F 19/04; F28F 17/00; F25B 13/00; F25B 39/00; F25B 39/02; F25B 39/04
(Continued)

(56) References Cited

U.S. PATENT DOCUMENTS 4,323,914 A 4/1982 Berndlmaier et al.
5,453,275 A 9/1995 Terry et al.
(Continued)

FOREIGN PATENT DOCUMENTS

CN 1721479 A 1/2006
CN 101839591 A 9/2010
(Continued)

OTHER PUBLICATIONS

International Search Report and Written Opinion regarding related PCT App. No. PCT/US2015/043225; dated Nov. 5, 2015; 8 pgs.
(Continued)

*Primary Examiner* — David D Hwu
(74) *Attorney, Agent, or Firm* — Cantor Colburn LLP

(57) ABSTRACT

A heat exchanger is disclosed for transferring heat from a first material to a second material comprises a structural heat transfer member having a first surface in contact with the first material and a second surface in contact with the second material. The heat exchanger also has a coating on the first surface, the second surface, or on the first and second surfaces. The coating comprises filler particles dispersed in a polymer resin matrix.

20 Claims, 4 Drawing Sheets

(51) Int. Cl.

| | |
|---|---|
| ***F28F 19/04*** | (2006.01) |
| ***F25B 13/00*** | (2006.01) |
| ***F25B 39/00*** | (2006.01) |
| *F25B 39/02* | (2006.01) |
| *F25B 39/04* | (2006.01) |

(58) Field of Classification Search
USPC ..... 165/133
See application file for complete search history.

(56) References Cited

U.S. PATENT DOCUMENTS

| | | | | |
|---|---|---|---|---|
| 6,350,843 | B1 * | 2/2002 | Fa | C08G 59/00 428/930 |
| 7,841,390 | B1 | 11/2010 | Kaser et al. | |
| 8,372,484 | B2 | 2/2013 | He et al. | |
| 9,833,772 | B2 * | 12/2017 | Cola | B01J 23/745 |
| 2002/0098970 | A1 * | 7/2002 | Tomomatsu | C01G 29/00 501/139 |
| 2006/0013881 | A1 | 1/2006 | Jang | |
| 2008/0248201 | A1 * | 10/2008 | Corkery | C09D 7/70 427/256 |
| 2009/0272144 | A1 * | 11/2009 | Lin | G06F 1/20 62/498 |
| 2010/0173167 | A1 | 7/2010 | Vissing et al. | |
| 2011/0165334 | A1 | 7/2011 | Okagaito et al. | |
| 2012/0181004 | A1 * | 7/2012 | Son | F28F 17/00 165/133 |
| 2012/0251742 | A1 | 10/2012 | Kerber | |
| 2013/0112379 | A1 | 5/2013 | Ko | |
| 2014/0069620 | A1 | 3/2014 | Reiko | |

FOREIGN PATENT DOCUMENTS

| | | | |
|---|---|---|---|
| CN | 101993602 | A | 3/2011 |
| CN | 102615866 | A | 8/2012 |
| CN | 102702978 | A | 10/2012 |
| CN | 103159463 | A | 6/2013 |
| CN | 104613441 | A | 5/2015 |
| DE | 4118895 | A1 | 3/1992 |
| EP | 0407474 | B1 | 9/1996 |
| EP | 2236974 | A2 | 10/2010 |
| EP | 2476990 | A2 | 7/2012 |
| WO | 9957185 | A1 | 11/1999 |
| WO | 2012157325 | A1 | 11/2012 |

OTHER PUBLICATIONS

Winey, et al., "Improving Electrical Conductivity and Thermal Properties of Polymers by the Addition of Carbon Nanotubes as Fillers," MRS Bulletin; vol. 32; Apr. 2007; pp. 348-353.

Chinese Office Action and Search Report from the Chinese Patent Office for CN Application No. 201580041682.3 dated Jul. 9, 2018, 13 pages, English Translation Included.

* cited by examiner

COATED HEAT EXCHANGER

CROSS-REFERENCES TO RELATED APPLICATIONS

This patent application is a national stage of International Patent Application Serial No. PCT/US2015/043225, filed Jul. 31, 2015, and claims the benefit of priority to U.S. Provisional Patent Application Ser. No. 62/031,740, filed Jul. 31, 2014, each of which are incorporated herein by reference in their entirety.

BACKGROUND OF THE INVENTION

The subject matter disclosed herein generally relates to heat exchangers and, more particularly, to heat exchangers having coatings thereon.

Heat exchangers are widely used in various applications, including but not limited to heating and cooling systems including fan coil units, heating and cooling in various industrial and chemical processes, heat recovery systems, and the like, to name a few. Many heat exchangers for transferring heat from one fluid to another fluid utilize one or more tubes through which one fluid flows while a second fluid flows around the tubes. Heat from one of the fluids is transferred to the other fluid by conduction through the tube walls. Many configurations also utilize fins in thermally conductive contact with the outside of the tube(s) to provide increased surface area across which heat can be transferred between the fluids, improve heat transfer characteristics of the second fluid flowing through the heat exchanger and enhance structural rigidity of the heat exchanger. Such heat exchangers include microchannel heat exchangers and round tube plate fin (RTPF) heat exchangers.

One of the primary functions of a heat exchanger is to transfer heat from one fluid to another in an efficient manner. Higher levels of heat transfer efficiency allow for reductions in heat exchanger size, which can provide for reduced material and manufacturing cost, as well as providing enhancements to efficiency and design of systems that utilize heat exchangers such as refrigeration systems. However, there are a number of impediments to improving heat exchanger system efficiency.

For example, many metal alloys used for heat exchanger construction such as aluminum alloys are subject to corrosion. Applications located in or close to marine environments, particularly, sea water or wind-blown seawater mist create an aggressive chloride environment that is detrimental for these heat exchangers. This chloride environment rapidly causes localized and general corrosion of braze joints, fins, and refrigerant tubes. The corrosion modes include galvanic, crevice, and pitting corrosion. Corrosion impairs the heat exchanger ability to transfer heat via several mechanisms including loss of structural integrity and thermal contact with refrigerant tubes. Corrosion products also accumulate on the heat exchanger external surfaces creating an extra thermal resistance layer and increasing airflow impedance. In addition, corrosion eventually leads to a loss of refrigerant due to tube perforation and failure of the cooling system. Polymer coatings are often used to protect heat exchanger surfaces from corrosion and physical damage. Many polymers, however, are inefficient conductors of heat, and their use as a protective coating can adversely affect heat transfer efficiency.

Additionally, heat exchangers used as evaporators in refrigeration systems are often subject to the formation of frost on the exterior surface of components of the heat exchanger such as heat exchanger fins and tubes. Frost on these heat exchanger surfaces adversely affects heat transfer efficiency by reducing heat transfer, which adversely affects the overall efficiency of the refrigeration system. Frost formation is often addressed by operating the refrigeration system in a defrost cycle, which further reduces system efficiency. Such adverse impacts on the refrigeration system often require the heat exchanger and other system components to be designed for larger capacity, leading to increased system cost and complexity, in addition to the increasing operating costs to meet system performance requirements.

In view of the above and other issues, there continues to be a need in the art for new approaches to heat exchanger design and manufacture.

BRIEF DESCRIPTION OF THE INVENTION

According to one aspect of the invention, a heat exchanger for transferring heat from a first material to a second material comprises a structural heat transfer member having a first surface in contact with the first material and a second surface in contact with the second material. The heat exchanger also has a coating on the first surface, the second surface, or on the first and second surfaces. The coating comprises filler particles that are nanoscopic in at least one dimension dispersed in a polymer resin matrix.

According to another aspect of the invention, a heat transfer system comprises a heat transfer fluid circulation loop, and the heat transfer fluid circulation loop includes the above-described heat exchanger. In such a system, the heat transfer fluid is the above-mentioned first material or second material that comes into contact with the heat exchanger. An example of such a heat transfer system is a vapor compression heat transfer system that comprises an evaporator heat exchanger, a compressor that receives heat transfer fluid from the evaporator heat exchanger, a condenser heat exchanger that receives heat transfer fluid from the condenser, and an expansion device that receives heat transfer fluid from the condenser heat exchanger and provides heat transfer fluid to the evaporator heat exchanger. In such a system, the coating comprising filler particles in a polymer resin matrix can be disposed on a surface of the evaporator heat exchanger or the condenser heat exchanger.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawing in which:

DETAILED DESCRIPTION OF THE INVENTION

Figure 1:
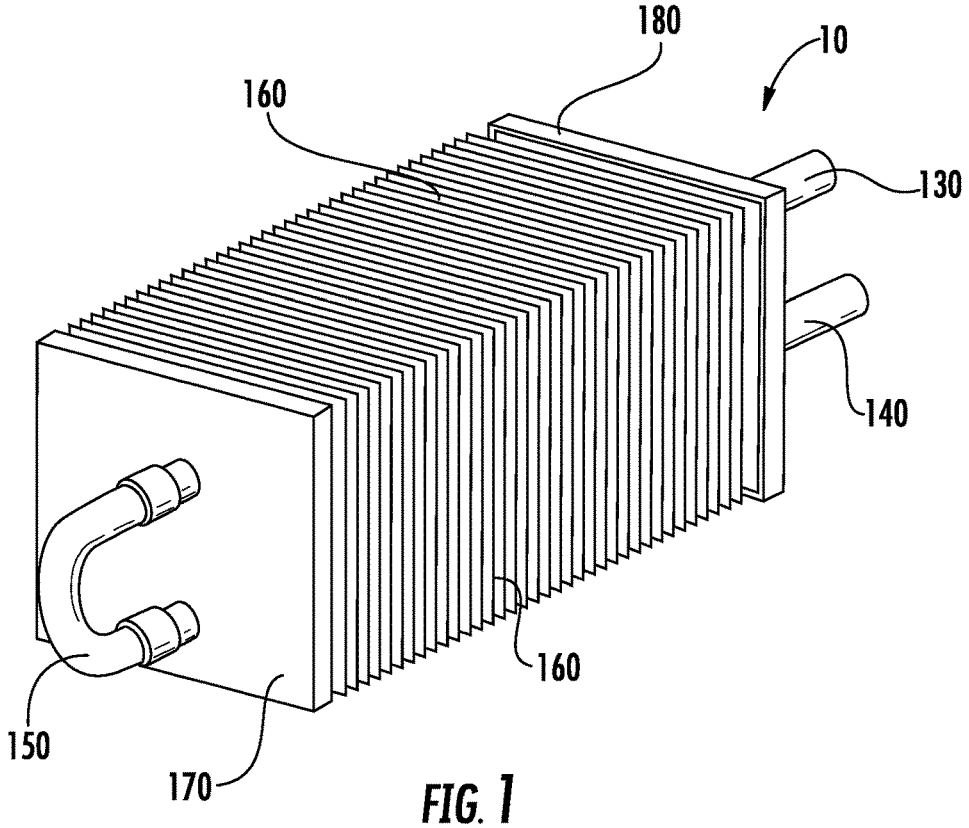
FIG. 1 depicts a schematic diagram of an exemplary heat exchanger.

Referring now to the Figures, an exemplary RTPF (round tube plate fin) heat exchanger is shown in FIG. 1. As shown in FIG. 1, a heat exchanger 10 includes one or more flow circuits for carrying a heat transfer fluid such as a refrigerant. For the purposes of explanation, the heat exchanger 10 is shown with a single flow circuit refrigerant tube having an inlet line 130 and an outlet line 140 connected by tube bend 150. The inlet line 130 is connected to the outlet line 140 at one end of the heat exchanger 10 through a 180 degree tube bend 150. It should be evident, however, that more circuits may be added to the unit depending upon the demands of the system. For example, although tube bend 150 is shown as a separate component connecting two straight tube sections, the tube can also be formed as a single tube piece with a hairpin section therein for the tube bend 150, and multiple units of such hairpin tubes can be connected with u-shaped connectors at the open ends to form a continuous longer flow path in a 'back-and-forth' configuration. The heat exchanger 10 further includes a series of fins 160 comprising radially disposed plate-like elements spaced along the length of the flow circuit, typically connected to the tube(s) with an interference fit. The fins 160 are provided between a pair of end plates or tube sheets 170 and 180 and are supported by the lines 130, 140 in order to define a gas flow passage through which conditioned air passes over the refrigerant tube and between the spaced fins 160. Fins 160 may include heat transfer enhancement elements such as louvers or texture.

Figure 2:
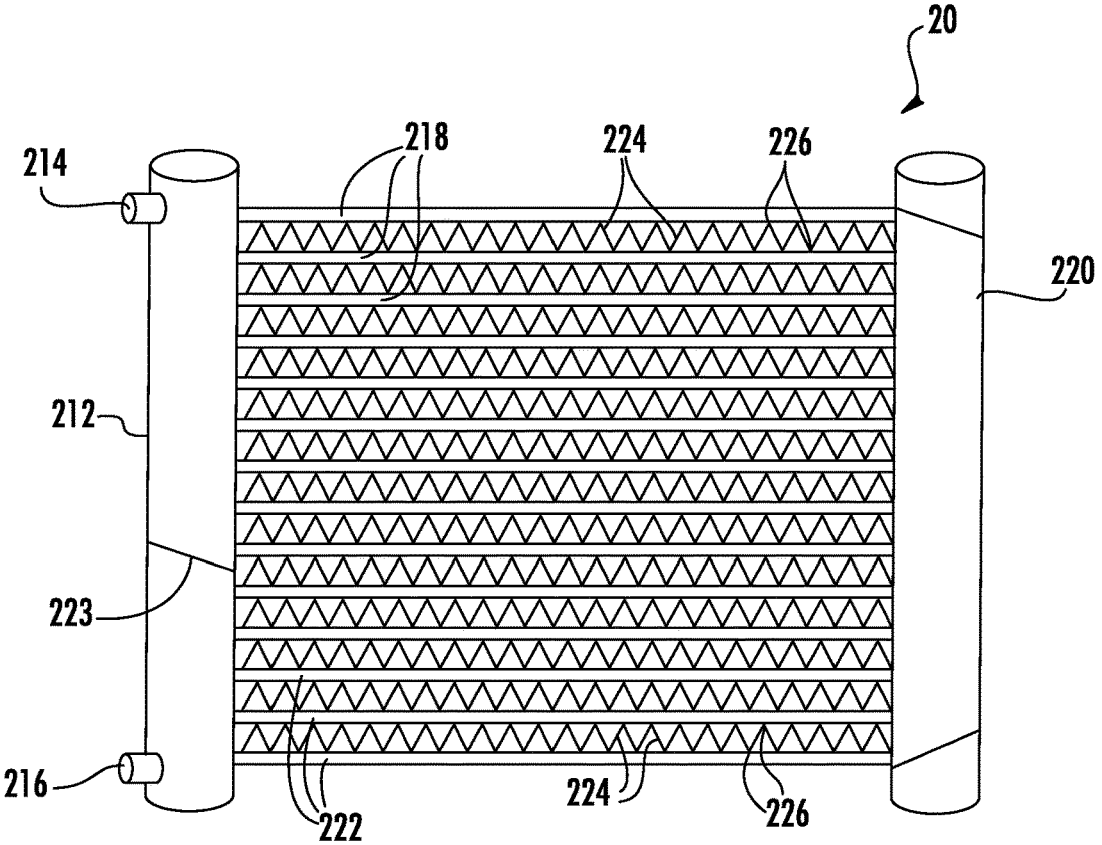
FIG. 2 depicts a schematic diagram of another exemplary heat exchanger.

Another type of exemplary heat exchanger that can be used according to the embodiments described herein is a micro-channel or mini-channel heat exchanger. The configuration of these types of heat exchangers is generally the same, with the primary difference being rather loosely applied based on the size of heat transfer tube ports. For the sake of convenience, this type of heat exchanger will be referred to herein as a micro-channel heat exchanger. As shown in FIG. 2, a micro-channel heat exchanger 20 includes first manifold 212 having inlet 214 for receiving a working fluid, such as coolant, and outlet 216 for discharging the working fluid. First manifold 212 is fluidly connected to each of a plurality of tubes 218 that are each fluidly connected on an opposite end with second manifold 220. Second manifold 220 is fluidly connected with each of a plurality of tubes 222 that return the working fluid to first manifold 212 for discharge through outlet 216. Partition 223 is located within first manifold 212 to separate inlet and outlet sections of first manifold 212. Tubes 218 and 222 can include channels, such as microchannels, for conveying the working fluid. The two-pass working fluid flow configuration described above is only one of many possible design arrangements. Single and other multi-pass fluid flow configurations can be obtained by placing partitions 223, inlet 214 and outlet 216 at specific locations within first manifold 212 and second manifold 220.

Fins 224 extend between tubes 218 and the tubes 222 as shown in the Figure. Fins 224 support tubes 218 and tubes 222 and establish open flow channels between the tubes 218 and tubes 222 (e.g., for airflow) to provide additional heat transfer surfaces and enhance heat transfer characteristics. Fins 224 also provide support to the heat exchanger structure. Fins 224 are bonded to tubes 218 and 222 at brazed joints 226. Fins 224 are not limited to the triangular cross-sections shown in FIG. 2, as other fin configurations (e.g., rectangular, trapezoidal, oval, sinusoidal) can be used as well. Fins 224 may have louvers or texture to improve heat transfer.

Heat exchanger surfaces can be formed from various materials, including but not limited to metal alloys such as aluminum or copper alloys. For example, refrigerant tubes can be made of an aluminum alloy based core material and, in some embodiments, may be made from aluminum alloys selected from 1000 series, 3000 series, 5000 series, or 6000 series aluminum alloys. The fins can be made of an aluminum alloy substrate material such as, for example, materials selected from the 1000 series, 3000 series, 6000 series, 7000 series, or 8000 series aluminum alloys. The embodiments described herein utilize an aluminum alloy for the fins of a tube-fin heat exchanger having an aluminum alloy tube, i.e., a so-called "all aluminum" heat exchanger. In some embodiments, components through which refrigerant flows, such as tubes and/or manifolds, can be made of an alloy that is electrochemically more cathodic than connected components through which refrigerant does not flow (e.g., fins). This ensures that any galvanic corrosion will occur in non-flow-through components rather than in flow-through components, in order to avoid refrigerant leaks.

Figure 3:
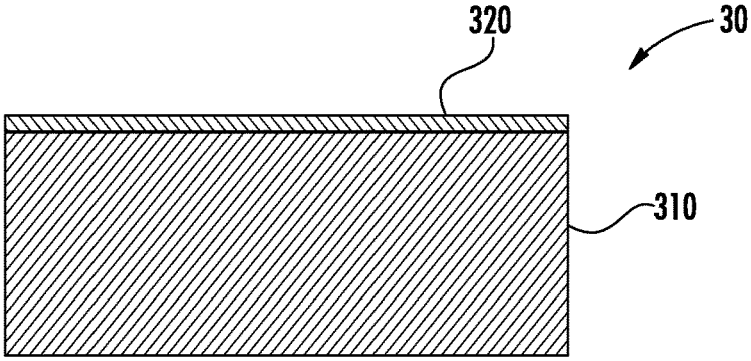
FIG. 3 depicts a schematic diagram of a cross-sectional view of a portion of the surface a coated heat exchanger.

Of course, the above-described RTPF and micro-channel heat exchangers are exemplary in nature, and describe a type of heat exchanger configured for flow of a heat transfer fluid through tubes or channels. Other types of heat exchangers can be used as well, such as passive heat exchangers attached to electronic components that radiate heat to ambient air adjacent to the component. A cross-section view of a portion 30 of a structural heat exchanger member is shown in FIG. 3. As shown in FIG. 3, structural heat exchanger member 310 has a surface coating 320 disposed thereon. The surface coating 320 comprises filler particles which can be nanoscopic in at least one dimesion in a polymer resin matrix or binder to create a polymer nanocomposite.

The polymer resin for the matrix can be chosen from any of a number of known polymer resins, including but not limited to polyurethanes, polyesters, polyacrylates, polyamides (e.g., nylon), polyphenylene sulfide, polyarylether ketone, poly(p-phenylene), polyphenylene oxide, polyethylene (including crosslinked polyethylene, i.e., PEX), polypropylene, polytetrafluoroethylene, as well as blends and copolymers of any of the above. In some embodiments, the polymer resin comprises $\pi$ orbital electrons in the molecular structure, which can enhance thermal conductivity when used in combination with functionalized filler particles. Such $\pi$ orbital electrons can be provided by aryl groups (e.g., phenyl or phenylene groups) in the molecular backbone or as functional groups appended to the polymer backbone. Examples of polymers having $\pi$ orbital electrons include but are not limited to polyphenylene sulfide, polyarylether ketone (e.g., polyether ether ketone, i.e., PEEK), poly(p-phenylene), and polyphenylene oxide.

A variety of different types of filler particles can be used, including but not limited to metals, ceramics, glasses, intermetallics, carbon, organics, hybrids (e.g., hybrid plastics such as polyhedral oligomeric silsesquioxane (POSS)), functionalized derivatives of the foregoing, as well as mixtures comprising any of the foregoing. Specific examples of fillers include, carbon nanotubes or nanoplatelets, graphene, buckyballs, nanofibers, boron nitride nanotubes or nanoplatelets, mica, clay, feldspar, quartz, quartzite, perlite, tripoli, diatomaceous earth, aluminum silicate (mullite), synthetic calcium silicate, fused silica, fumed silica, boron-silicate, calcium sulfate, calcium carbonates (such as chalk, limestone, marble, and synthetic precipitated calcium carbonates), talc (including fibrous, modular, needle shaped, and lamellar talc), wollastonite, aluminosilicate, kaolin, silicon carbide, alumina, boron carbide, iron, nickel, copper, continuous and chopped carbon fibers or glass fibers, molybdenum sulfide, zinc sulfide, barium titanate, barium ferrite, barium sulfate, heavy spar, $TiO_2$, aluminum oxide, magnesium oxide, aluminum, bronze, zinc, aluminum diboride, steel, organic fillers such as polyimide, polybenzoxazole, poly(phenylene sulfide), aromatic polyamides, aromatic polyimides, polyetherimides, and polytetrafluoroethylene. In some embodiments, such as embodiments where the molecular structure polymer resin includes $\pi$ electrons, the filler particles can be functionalized with groups including but not limited to carboxylic acid, hydroxide, oxide, and amine groups that would preferentially interact with polymer resin to reduce interfacial thermal resistance between the particles and the polymer resin matrix.

As mentioned above, the filler particles are nanoscopic in at least one direction. Filler particles can have various configurations, habits or morphologies, including spheres or spheroids, fibers, rods, tubules, platelets, ovular, and irregular shapes, and the nanoscopic dimension can be a diameter, length, width, or thickness, etc., depending on the configuration, habit, or morphology of the particles. As used herein, the term "nanoscopic" means that the particles have at least one dimension (i.e., a straight line distance between surfaces on opposite sides of the particle) of less than 1000 nm, more specifically less than 500 nm, even more specifically less than 100 nm, even more specifically less than 50 nm, and even more specifically less than 10 nm. In some embodiments, the filler particles can have a minimum size of 1 nm, more specifically 5 nm. The relative amounts of polymer resin matrix and filler particles can vary depending on the targeted performance characteristics of the coating. Exemplary amounts of filler are expressed as volume percent filler particles based on the total coating volume. Exemplary lower ends of the range can be 0.5 vol. %, more specifically 1 vol. %. Exemplary upper ends of the range can be 40 vol. %, more specifically 20 vol. %, and even more specifically 10 vol. %.

It has been discovered that, at a nanoscopic level, interfacial thermal resistance between the filler particles and surrounding particles of polymer resin matrix can have an unexpectedly significant effect on the bulk thermal conductivity of the coating, even for particles having a high thermal conductivity. In some embodiments, the interfacial thermal resistance between individual filler particles and surrounding particles of polymer resin matrix is less than or equal to $7\times10^{-7}$ $m^2$-K/W. In some embodiments, the interfacial thermal resistance between individual filler particles and surrounding particles of polymer resin matrix is less than or equal to $7\times10^{-8}$ $m^2$-K/W. In some embodiments, the interfacial thermal resistance between individual filler particles and surrounding particles of polymer resin matrix is less than or equal to $7\times10^{-9}$ $m^2$-K/W. Thermal conductivity of the nanoscopic particles themselves is also relevant, and in some embodiments, the thermal conductivity of the nanoscopic particles is at least 30 W/m-K. In some embodiments, the thermal conductivity of the nanoscopic particles is at least 300 W/m-K. In some embodiments, the thermal conductivity of the nanoscopic particles is at least 3000 W/m-K.

Figure 4:
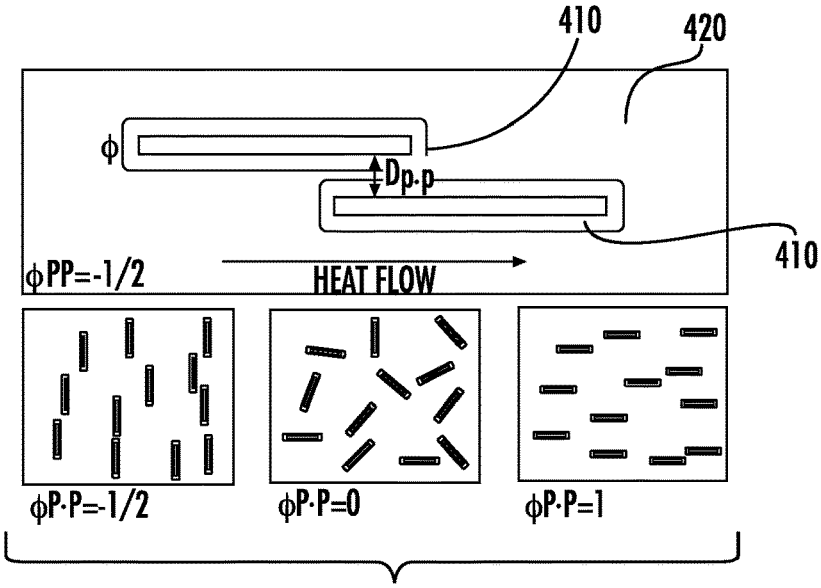
FIG. 4 depicts a schematic representation of filler particles in a coating.

Interparticle distance and orientation can also have an impact on the bulk thermal conductivity of the coating. These phenomenon are illustrated in FIG. 4 for nanoscopic particles in the form of rods/tubules/fibers 410 dispersed in a polymer matrix 420. Lower interparticle distances $D_{P\text{-}P}$ tend to provide increased bulk thermal conductivity, and alignment of the particles lengthwise in the direction of heat flow. Alignment of the particles configured as rods, tubules, fibers, or platelets can be characterized by $\phi_{p,p}$, with a value of 0 representing random alignment of the particles, a value of 1 representing complete alignment of the particles in the direction of heat flow, and a value of −½ representing complete alignment of the particles perpendicular to the direction of heat flow. In exemplary embodiments, $\phi_{p,p}$ is in a range having a lower level greater than 0, more specifically greater than or equal to 0.1, and even more specifically greater than or equal to 0.2. The upper end of the range for $\phi_{p,p}$ can be less than or equal to 1.0, more specifically less than or equal to 0.7, and even more specifically less than or equal to 0.5. Interparticle distance is generally a function of particle orientation and loading levels of the particles in the coating. Orientation of the particles can be controlled or influenced by coating techniques (e.g., atomized spray coating, dip coating, electrostatic coating, etc.) or by growing the nanotubes in a vertical forest configuration (as is known in the art) on the heat exchanger surface and top-coating with a polymer resin. Other methods for particle alignment in coatings could be via an externally applied field (electrical, magnetic, etc.) to an uncured or otherwise unsolidified resin. Such fields can be applied in a continuous or pulsed manner to impart particular properties to the coating. Additionally, aligned fillers can be implanted into the resin via a transfer film or paper with pre-aligned particles that can be transferred to the resin via hot embossing or other transfer techniques.

Nanoscopic particle fillers can also provide the coating with a surface roughness that can provide resistance to frost formation on the coated heat exchanger surface(s). In some embodiments, the coating has hierarchical surface roughness with nanoscale roughness on microscale roughness features imparting a hydrophobic or superhydrophobic property to the surface and delaying the formation of frost on the surface. In one non-limiting example, the microscale roughness may have an Ra value ranging from approximately 5 microns to approximately 100 microns and the nanoscale roughness may have an Ra value ranging from approximately 250 nanometers to approximately 750 nanometers.

Figure 5:
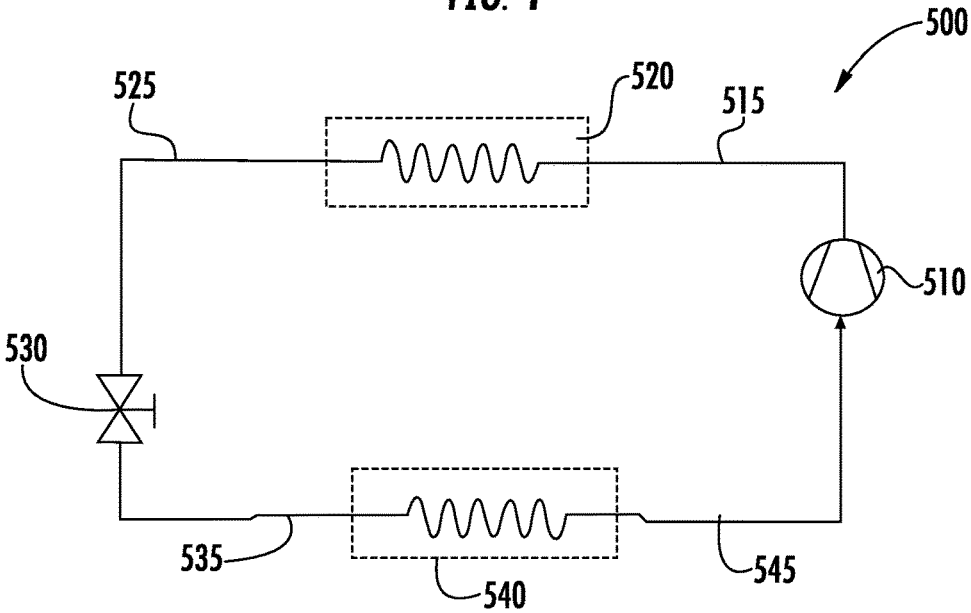
FIG. 5 depicts a schematic diagram of an exemplary heat transfer system.

The above-described heat exchanger embodiments can be utilized in various types of heat transfer systems such as heat transfer systems that have a heat transfer fluid circulation loop. An exemplary heat transfer system 500 with a heat transfer fluid circulation loop is shown in block diagram form in FIG. 5. As shown in FIG. 5, a compressor 510 pressurizes heat transfer fluid in its gaseous state, which both heats the fluid and provides pressure to circulate it throughout the system. The hot pressurized gaseous heat transfer fluid exiting from the compressor 510 flows through conduit 515 to condenser heat exchanger 520, which functions as a heat exchanger to transfer heat from the heat transfer fluid to the surrounding environment, resulting in condensation of the hot gaseous heat transfer fluid to a pressurized moderate temperature liquid. The liquid heat transfer fluid exiting from the condenser 520 flows through conduit 525 to expansion valve 530, where the pressure is reduced. The reduced pressure liquid heat transfer fluid exiting the expansion valve 530 flows through conduit 535 to evaporator heat exchanger 540, which functions as a heat exchanger to absorb heat from the surrounding environment and boil the heat transfer fluid. Gaseous heat transfer fluid exiting the evaporator 540 flows through conduit 545 to the compressor 510, thus completing the heat transfer fluid loop. The heat transfer system has the effect of transferring heat from the environment surrounding the evaporator 540 to the environment surrounding the condenser 520. The thermodynamic properties of the heat transfer fluid allow it to reach a high enough temperature when compressed so that it is greater than the environment surrounding the condenser 520, allowing heat to be transferred to the surrounding environment. The thermodynamic properties of the heat transfer fluid must also have a boiling point at its post-expansion pressure that allows the environment surrounding the evaporator 540 to provide heat at a temperature to vaporize the liquid heat transfer fluid.

The heat transfer system shown in FIG. 5 can be used as an air conditioning system, in which the exterior of condenser heat exchanger 520 is contacted with air in the surrounding outside environment and the evaporator heat exchanger 540 is contacted with air in an interior environment to be conditioned. Additionally, as is known in the art, the system can also be operated in heat pump mode using a standard multiport switching valve to reverse heat transfer fluid flow direction and the function of the condenser and evaporator heat exchangers, i.e. the condenser in a cooling mode being evaporator in a heat pump mode and the evaporator in a cooling mode being the condenser in a heat pump mode. Additionally, while the heat transfer system shown in FIG. 5 has evaporation and condensation stages for highly efficient heat transfer, other types of heat transfer fluid loops are contemplated as well, such as fluid loops that do not involve a phase change, for example, multi-loop systems such as commercial refrigeration or air conditioning systems where a non-phase change loop thermally connects one of the heat exchangers in an evaporation/condensation loop like FIG. 5 to a surrounding outside environment or to an interior environment to be conditioned. Regardless of the specific configuration of the heat transfer fluid circulation loop, a coated heat exchanger as described herein can be disposed in a potentially corrosive environment such as a marine, ocean shore, or industrial environment.

The invention is further described in the following examples.

EXAMPLES

Figure 6:
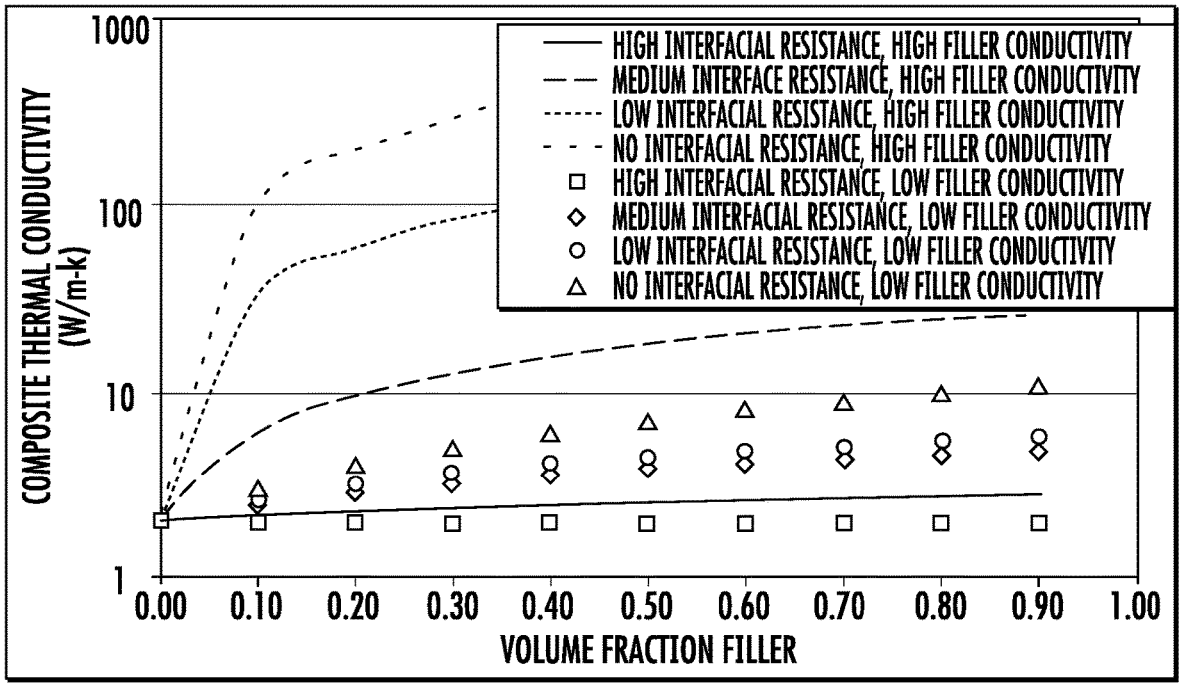
FIG. 6 depicts a plot of thermal conductivity of coatings as a function of filler thermal conductivity as described herein.

Thermal conductivity of the polymer nanocomposites was determined using an effective medium approach to relate the interfacial thermal resistance to the bulk thermal conductivity. The interfacial thermal resistance was determined using molecular dynamics by modeling a periodic cell with a single carbon nanotube filler particle (nominal particle size of 20,000 nm×1 nm) surrounded by matrix particles. The filler particle is heated up and the temperature difference between the matrix and filler is monitored as the system equilibrates. This temperature difference is used to determine the interfacial resistance, which is used in an effective medium approximation to calculate the bulk thermal conductivity. These results for different combinations of thermal conductivity of the nanoscopic particle material and the interfacial thermal resistance between the particle and surrounding polymer resin matrix are shown in FIG. 6. As shown in FIG. 6, interfacial resistance plays a key role in determining the thermal conductivity of the composite. Highly thermally conductive filler particles are less effective at improving thermal conductivity when the interfacial resistance between filler particles and the matrix is high.

Figure 7:
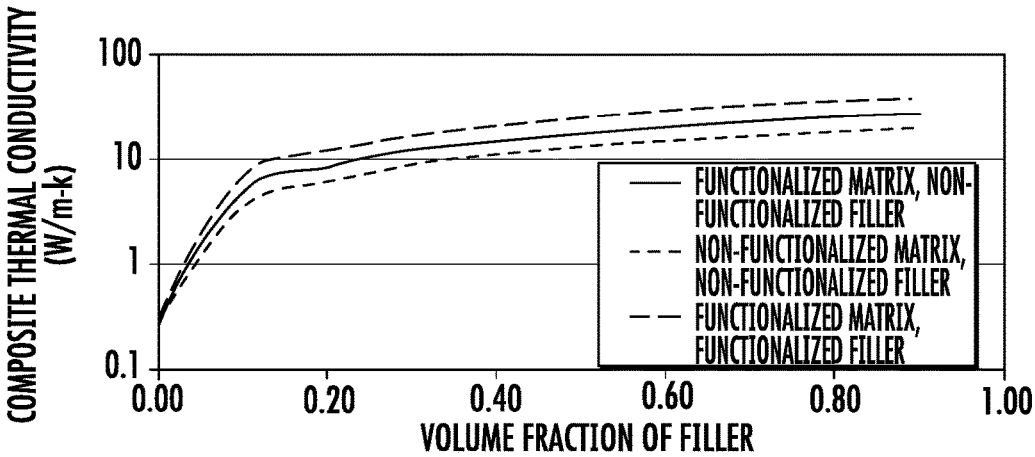
FIG. 7 depicts a plot of thermal conductivity of coatings as a function of filler surface treatment as described herein.

FIG. 7 depicts results for the effect of interactions between the filler particles and polymer resin matrix. As shown in FIG. 7, a phenylene group-containing polymer resin, e.g., polyphenylene sulfide resin, which has phenylene groups that carry $\pi$ electrons, provides higher bulk thermal conductivity in combination with carbon nanotube particles (nominal particle size of 20,000 nm×1 nm) than polypropylene, which does not have phenylene groups or $\pi$ electrons. COOH-functionalized carbon nanotubes, in combination with polyphenylene sulfide polymer resin matrix, provides even higher bulk thermal conductivity at all loading levels.

Figure 8:
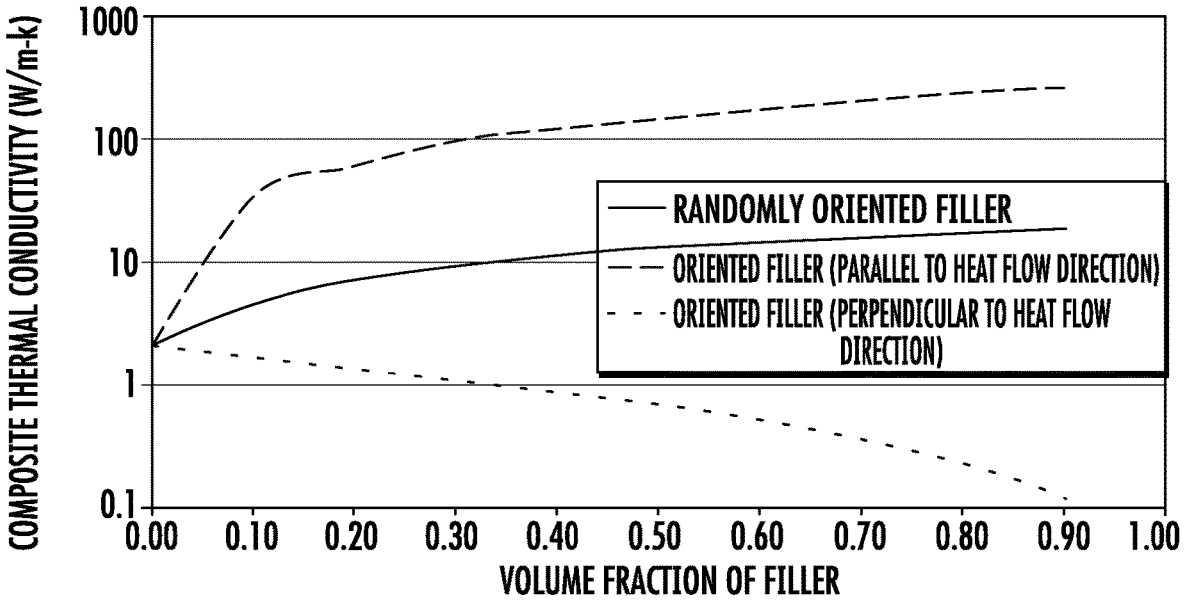
FIG. 8 depicts a plot of thermal conductivity of coatings as a function of filler orientation as described herein.

FIG. 8 depicts results for the effect of carbon nanotube (nominal particle size of 20,000 nm×1 nm, thermal conductivity 300 W/m-K) particle orientation in a polyphenylene sulfide polymer (thermal conductivity 2 W/m-K) matrix. Random orientation of CNT is represented by the solid line, orientation of CNT parallel to the heat flow direction is represented by the dashed line, and orientation of CNT perpendicular to heat flow direction is represented by the dotted line. As shown in FIG. 8, longitudinal alignment of the CNTs in the direction of heat flow measurement significantly improves thermal conductivity.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat exchanger for transferring heat from a first material to a second material, comprising:

a structural heat transfer member having a first surface in contact with the first material and a second surface in contact with the second material; and a coating disposed on the first surface or the second surface, or disposed on the first and second surfaces, the coating comprising rod, tubule, fiber, or platelet filler particles that are nanoscopic in at least one dimension dispersed in a polymer resin matrix and aligned in a direction perpendicular to said surface on which the coating is disposed.

2. The heat exchanger of claim 1, wherein the interfacial thermal resistance between the individual filler particles and the polymer resin matrix is less than or equal to $7\times10^{-7}$ $m^2$-K/W.

3. The heat exchanger of claim 1, wherein the interfacial thermal resistance between the individual filler particles and the polymer resin matrix is less than or equal to $7\times10^{-8}$ $m^2$-K/W.

4. The heat exchanger of claim 1, wherein the interfacial thermal resistance between the individual filler particles and the polymer resin matrix is less than or equal to $7\times10^{-9}$ $m^2$-K/W.

5. The heat exchanger of claim 1, wherein the thermal conductivity of the individual filler particles is at least 30 W/m–K.

6. The heat exchanger of claim 5, wherein the thermal conductivity of the individual filler particles is at least 300 W/m-K.

7. The heat exchanger of claim 6, wherein the thermal conductivity of the individual filler particles is at least 3000 W/m-K.

8. The heat exchanger of claim 1, wherein the filler particles have at least one dimension less than or equal to 500 nm.

9. The heat exchanger of claim 8, wherein the filler particles have at least one dimension less than or equal to 100 nm.

10. The heat exchanger of claim 1, wherein the surface of the coating is hydrophobic.

11. The heat exchanger of claim 1, wherein the filler particles have an orientation ratio $\phi_{p,p}$ of greater than or equal to 0.

12. The heat exchanger of claim 1, wherein the filler particles comprise carbon nanotubes, carbon nanoplatelets, graphene, boron nitride nanotubes, or boron nanoplatelets.

13. The heat exchanger of claim 1, wherein the polymer resin comprises $\pi$ orbital electrons.

14. The heat exchanger of claim 13, wherein the polymer resin comprises phenyl or phenylene groups.

15. The heat exchanger of claim 14, wherein the polymer resin comprises polyphenylene sulfide, polyarylether ketone, poly(p-phenylene), polyphenylene oxide.

16. The heat exchanger of claim 13, wherein the filler particles are functionalized with carboxylic acid groups, hydroxide, oxide, or amine.

17. The heat exchanger of claim 1 wherein the coating has a hierarchical surface roughness with microscale and nanoscale roughness.

18. A heat transfer system comprising a heat transfer fluid circulation loop, including the heat exchanger of claim 1 disposed in the heat transfer fluid circulation loop.

19. The heat transfer system of claim 18 that is a vapor compression heat transfer system that comprises an evaporator heat exchanger, a compressor that receives heat transfer fluid from the evaporator heat exchanger, a condenser heat exchanger that receives heat transfer fluid from the condenser, an expansion device that receives heat transfer fluid from the condenser heat exchanger and provides heat transfer fluid to the evaporator heat exchanger, wherein the heat exchanger of claim 1 is the evaporator heat exchanger or the condenser heat exchanger.

20. A method of operating the heat transfer system of claim 18, comprising circulating the heat transfer fluid through the heat transfer fluid circulation loop to transfer heat from the first material to the second material, wherein the coated surface of the heat exchanger of claim 1 is subjected to a temperature below the freezing point of water.

* * * * *